US007361890B2

(12) United States Patent
Patterson

(10) Patent No.: US 7,361,890 B2
(45) Date of Patent: Apr. 22, 2008

(54) ANALYTICAL INSTRUMENTS, ASSEMBLIES, AND METHODS

(75) Inventor: Garth E. Patterson, Brookston, IN (US)

(73) Assignee: Griffin Analytical Technologies, Inc., West Lafayette, IN (US)

( * ) Notice: Subject to any disclaimer, the term of this patent is extended or adjusted under 35 U.S.C. 154(b) by 187 days.

(21) Appl. No.: 11/173,263

(22) Filed: Jun. 30, 2005

(65) Prior Publication Data

US 2006/0016975 A1 Jan. 26, 2006

Related U.S. Application Data

(60) Provisional application No. 60/585,113, filed on Jul. 2, 2004.

(51) Int. Cl.
*H01J 49/04* (2006.01)
*H01J 49/10* (2006.01)

(52) U.S. Cl. ..... 250/288; 250/281; 250/282

(58) Field of Classification Search ..... 250/287, 250/288, 281, 282
See application file for complete search history.

(56) References Cited

U.S. PATENT DOCUMENTS 5,468,296 A * 11/1995 Patrick et al. ..... 118/723 MP
6,295,860 B1 10/2001 Sakairi et al.
6,707,039 B1 * 3/2004 Truche et al. ..... 250/288
6,825,462 B2 * 11/2004 Truche et al. ..... 250/288
6,858,841 B2 * 2/2005 Truche et al. ..... 250/288
2003/0129835 A1 * 7/2003 Kholodenko et al. ..... 438/689
2006/0284116 A1 * 12/2006 Berrian et al. ..... 250/492.21

OTHER PUBLICATIONS

Creaser, C.S.; Weston, D.J.; *In-Membrane Preconcentration/Membrane Inlet Mass Spectrometry of Volatile and Semivolatile Organic Compounds*, Anal. Chem. 2000, 72, 2730-2736.

Lauritsen, F.R.; Ketola, R.A., *Quantitative Determination of Semivolatile Organic Compounds in Solution Using Trap-and-Release Membrane Inlet Mass Spectrometry*, Anal. Chem. 1997, 69, 4917-4922.

(Continued)

*Primary Examiner*—Nikita Wells
*Assistant Examiner*—Johnnie L Smith, II
(74) *Attorney, Agent, or Firm*—Wells St. John P.S.

(57) ABSTRACT

Instrument assemblies including a support coupled to an active substrate are provided with the support being configured to be coupled to an interior portion of an ionization chamber. Instruments are also provided that can include a chamber being configured to contact at least a portion of a sample with an ionization species. The instruments can also include an active substrate within the chamber. Analysis methods are provided that can include providing a sample to a chamber and selectively retaining at least a portion of the first analyte of the sample within the chamber without retaining at least a portion of the second analyte within the chamber. Analysis methods can also include providing a sample to a chamber housing an active substrate, contacting at least a portion of the sample with the substrate, and ionizing the portion of the sample.

15 Claims, 5 Drawing Sheets

OTHER PUBLICATIONS

Kok, G.L.; Cisper, M.E.; Hemberger, P.H., *Air Analysis Using Tenax Collection with Jet-Separator Enrichment and Ion Trap Mass Spectrometric Analysis*, J. Am. Soc. Mass Spectrom. 1996, 7, 1172-1176.

Ketola, R.A.; Gron, C.; Lauritsen, F.R.; *Temperature Programmed Desorption for Membrane Inlet Mass Spectrometry*, Rapid Commun. Mass Spectrom. 1998, 12, 773-778.

Riter, L.S.; Takats, Z.; Cooks, R.G. *Single-Sided Membrane Inlet Mass Spectrometry for On-Line Determination of Semi-volatile Organic Compounds in Air*, Proceedings of the 49th ASMS Conference on Mass Spectrometry and Allied Topics, Chicago, IL, May 27-31, 2001; TPH 191.

Riter, L.S.; Takats, Z.; Cooks, R.G., *Single-Sided Membrane Introduction Mass Spectrometry for On-Line Determination of Semi-volatile Organic Compounds in Air*, Analyst 2001, 126, 1980-1984.

Ketola, R.A.; Lauritsen, F.R., *Detection of Dicarboxylic Acids in Aqueous Samples Using Membrane Inlet Mass Spectrometry with Desorption Chemical Ionization*, Rapid Comm. Mass Spectrom. 1999, 13, 749-751.

Lauritsen, F.R.; Choudhury, T.K.; Dejarme, L.E.; Cooks, R.G., *Microporous Membrane Introduction Mass Spectrometry with Solvent Chemical Ionization and Glow Discharge for the Direct Detection of Volatile Organic Compounds in Aqueous Solution*, Anal. Chem. Acta 1992, 266, 1-12.

* cited by examiner

ANALYTICAL INSTRUMENTS, ASSEMBLIES, AND METHODS

CLAIM FOR PRIORITY

This application claims priority under 35 USC § 119 to U.S. Provisional Patent Application Ser. No. 60/585,113 filed Jul. 2, 2004, entitled Spectrometry Instruments, Assemblies and Methods, the entirety of which is incorporated by reference herein.

TECHNICAL FIELD

The present disclosure relates generally to analytical instruments, assemblies, and methods. More particularly the present disclosure relates to ionization instruments, ionization assemblies, and ionization methods.

BACKGROUND

Analytical instrumentation can be used to determine both qualitative and quantitative information about the composition of both inorganic and organic samples. Instrumentation such as mass spectrometry instrumentation can be used to determine the structures of a wide variety of complex molecular species. Additionally, mass spectrometry can be utilized to determine the structure and composition of solid surfaces as well.

As early as 1920, the behavior of ions in magnetic fields was described for the purposes of determining the isotopic abundances of elements. In the 1960s, a theory describing fragmentation of molecular species was developed for the purpose of identifying structures of complex molecules. In the 1970s, mass spectrometers and new ionization techniques were introduced providing high-speed analysis of complex mixtures and thereby enhancing the capacity for structure determination.

Advances in data acquisition and processing have provided for increased sensitivity and accuracy of mass spectrometry instrumentation. U.S. Pat. No. 6,253,162 to Jarman, et al. describes a method of identifying features in indexed analytical data, especially useful for distinguishing signal from noise in data provided as a plurality of ordered pairs, the entirety of which is hereby incorporated by reference. Also, U.S. Pat. No. 6,487,523 to Jarman, et al. describes a method and apparatus to characterize the presence of peaks in an indexed data set for samples that match a reference species, the entirety of which is hereby incorporated by reference.

With these advances there remains a need for analytical instrumentation to perform multiple functions within a smaller physical space. A need remains for portable analytical instrumentation, while in others a need remains to increase throughput by reducing loss mechanisms. The present disclosure provides instruments, assemblies, and/or methods that can be used, in exemplary embodiments, to meet these needs.

SUMMARY

Instrument assemblies including a support coupled to an active substrate are provided with the support being configured to be coupled to an interior portion of an ionization chamber.

Instruments are also provided that can include a chamber having a continuous volume, with the chamber being configured to contact at least a portion of a sample with an ionization species within the volume. The instruments can also include an active substrate within the volume of the chamber.

Analysis methods are provided that can include providing a sample to a chamber with the sample including at least first and second analytes. The methods can also include selectively retaining at least a portion of the first analyte within the chamber without retaining at least a portion of the second analyte within the chamber, and contacting the portion of the first analyte with an ionization species.

Analysis methods can also include providing a sample to a chamber housing an active substrate, contacting at least a portion of the sample with the substrate, and ionizing the portion of the sample.

Other aspects are contemplated.

BRIEF DESCRIPTION OF THE DRAWINGS

Embodiments of the invention are described below with reference to the following accompanying drawings.

FIG. 6 is the mass spectra of methyl salicylate that can be acquired utilizing the instrument of FIG. 1 according to an embodiment.

DETAILED DESCRIPTION

This disclosure of the invention is submitted in furtherance of the constitutional purposes of the U.S. Patent Laws "to promote the progress of science and useful arts" (Article 1, Section 8).

Figure 1:
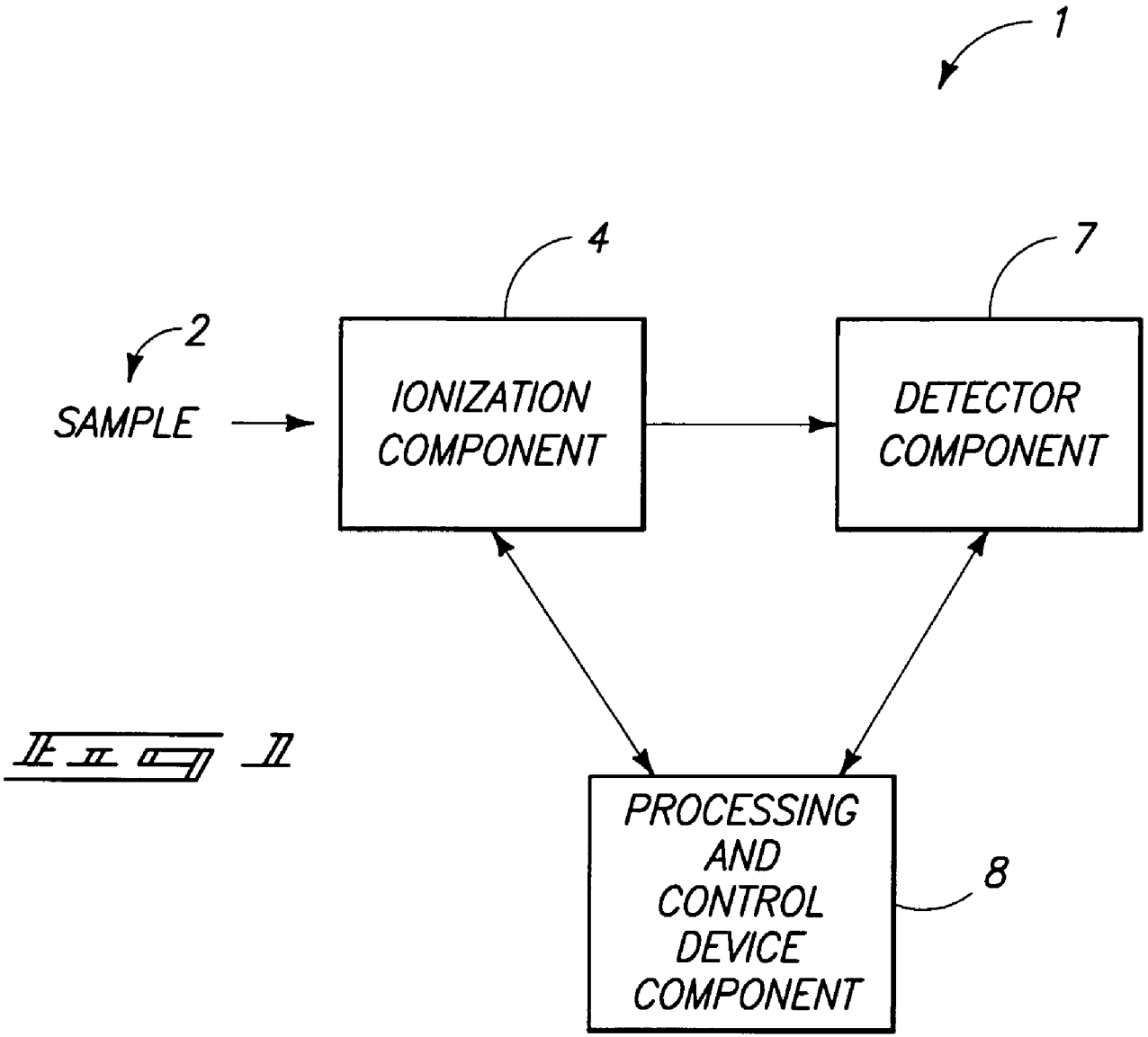
FIG. 1 depicts a block diagram of an instrument according to an embodiment.

Exemplary embodiments of the disclosure are described with reference to FIGS. 1-6. Referring to FIG. 1, an exemplary instrument 1 is depicted that includes an ionization component 4 coupled to both a detector component 7 and a processing and control device component 8. In exemplary embodiments, instrument 1 can be configured as a mass spectrometer by including a mass analyzer component (not shown) between ionization component 4 and detector component 7. Processing and control device component 8 can be coupled to one or more of components 4 and 7, as well as other components, including mass analyzer components not shown. Instrument 1 can be configured to receive a sample 2 and provide either or both of qualitative and/or quantitative data via processing and control device component 8, for example. Instrument 1 may also be configured as described in U.S. Provisional Patent Application Nos. 60/580,144, filed Jun. 15, 2004, entitled Instrument Assemblies and Methods and 60/580,582, filed Jun. 16, 2004, entitled Mass Spectrometry Instruments, the entirety of which are incorporated by reference herein. Instrument 1 can also be configured as described in International Application PCT/US05/20783, filed Jun. 13, 2005, entitled Analytical Instruments, Assemblies, and Methods, the entirety of which is incorporated by reference herein.

Sample 2 can be any chemical composition including either or both inorganic and organic substances in solid, liquid and/or vapor form as well as atomic species. Specific examples of samples suitable for analysis include volatile compounds such as toluene and more highly complex non-volatile protein based structures such as bradykinin. In certain aspects, sample 2 can be a mixture containing analytes, such as first and second analytes, and/or in other aspects sample 2 can be a substantially pure substance. Analysis of sample 2 will now be described with reference to aspects of ionization component 4.

Figure 2:
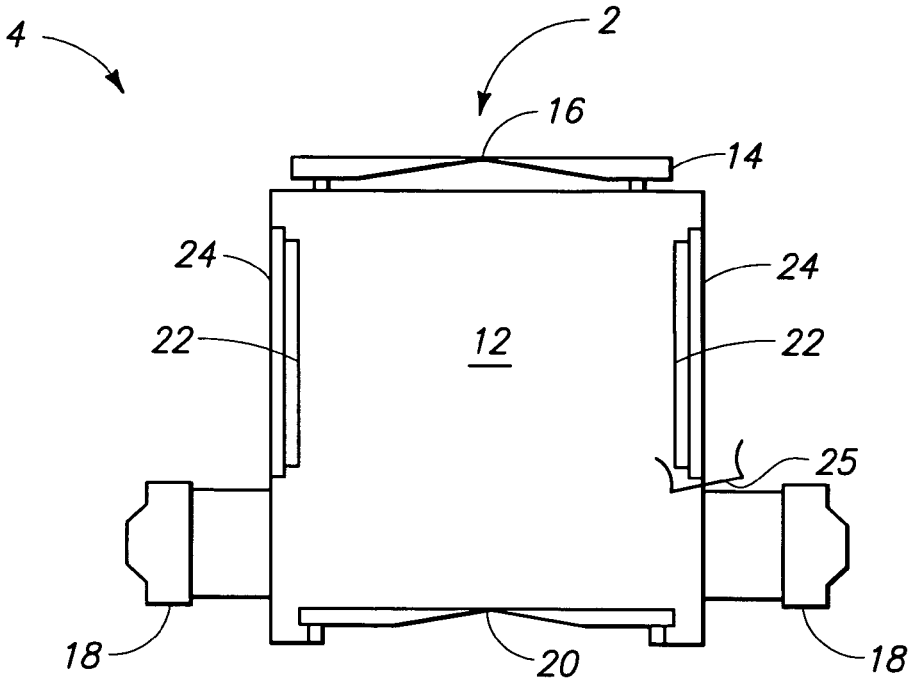
FIG. 2 is a cross-section view of a component of the instrument of FIG. 1 according to an embodiment.

Referring to FIG. 2, an exemplary ionization component 4 is shown according to an embodiment. In one embodiment, ionization component 4 can be configured to pre-concentrate and ionize at least a portion of sample 2, including analytes of sample 2, for example. In an exemplary aspect of the present disclosure, ion source component 4 can include active material, such as an active substrate. According to exemplary configurations, component 4 can be used to selectively concentrate analytes of interest within samples and provide ions of interest to various ion analyzing instrumentation, such as detector component 7, when coupled to processing and control device component 8, for example. Exemplary ion analyzing instrumentation that may be utilized include mass spectrometry instrumentation such as ion trap, quadruple MS, MS/MS, time-of-flight, sector, ICR and linear ion trap instruments. Instruments configured according to the present disclosure can prove particularly useful in combination with spectrometry instruments for the analysis of mixtures in circumstances where chromatography or other sample preparation components and separation techniques are not practical.

According to an aspect of the present disclosure, component 4 includes a chamber 12. Exemplary embodiments of chamber 12 can be configured as described in International Patent Application No. PCT/US04/01144, filed Jan. 16, 2004, entitled Mass Spectrometer Assemblies, Mass Spectrometry Vacuum Chamber Lid Assemblies, and Mass Spectrometer Operational Methods, the entirety of which is incorporated by reference herein. Chamber 12 can be configured as an ionization chamber, for example, having pressure control ports 18, that can be connected to a pump (not shown) to facilitate less than atmospheric pressure within the volume of chamber 12.

Component 4 can be configured, in exemplary embodiments, to receive sample 2 directly or, in other exemplary embodiments, to receive sample 2 from sample inlet component (not shown). For example component 4 can be configured as described in U.S. patent application Ser. No. 11/152,395, filed Jun. 13, 2005 entitled Instrument Assemblies and Analysis Methods, the entirety of which is incorporated by reference herein. Component 4 can be configured to convert portions and/or an entirety of sample 2 into analyte ions and/or ionized analytes, for example. This conversion can include the bombardment of sample 2 with ionization species such as; electrons, ions, molecules, and/or photons. Thermal and/or electrical energy may also be utilized as ionization species to prepare ionized analytes as well. Component 4 can be configured to generate ionization species within the volume of chamber 12 and/or receive ionization species from outside the volume of chamber 12, for example.

Component 4 may utilize, for example, electron ionization (EI, typically suitable for the gas phase ionization), photo ionization (PI), chemical ionization, collisionally activated disassociation and/or electrospray ionization (ESI). For example, in PI, the photo energy can be varied to vary the internal energy of the sample. Also, when utilizing ESI, sample 2 can be energized under atmospheric pressure and potentials applied when transporting ions into a volume of exemplary chamber 12 can be varied to cause varying degrees of dissociation. Potentials applied when utilizing ESI can be varied to cause varying degrees of dissociation as described in International Application number PCT/US04/012849 filed Apr. 26, 2004, entitled Instrumentation, Articles of Manufacture, and Analysis Methods, the entirety of which is incorporated by reference herein. Furthermore, exemplary component 4 includes those described in U.S. Provisional Patent Application No. 60/585,113 filed Jul. 2, 2004, entitled Spectrometry Instruments, Assemblies and Methods, the entirety of which is incorporated by reference herein.

According to exemplary embodiments, chamber 12 can have a continuous volume and/or contact at least a portion of sample 2 with ionization species. For example, chamber 12 can include a discharge plate 14 that can be configured to have an electrical potential applied thereto, the electrical potential facilitating the discharge of ionization species, such as electrons. Discharge plate 14 may be configured with an orifice 16 to facilitate the receipt of sample 2 within the volume of chamber 12. In an exemplary aspect, a portion of discharge plate 14 can be thinned to allow for machining of orifice 16. Component 4 can also include an exit orifice 20 that may be aligned with detector component 7 (FIG. 1) and/or additional components (not shown) to receive ionized analytes from chamber 12 for analysis. Component 4 can also be configured to contact at least a portion of sample 2 with an ionization species proximate substrate 22. Exemplary configurations of component 4 include those described in U.S. Pat. No. 4,849,628 filed Nov. 4, 1988, entitled Atmospheric Sampling Glow Discharge Ionization Source, the entirety of which is incorporated by reference herein.

In active substrate 22 can be within the volume of chamber 12. Examples of substrate 22 that may be utilized in accordance with the present invention include: Tenax (TA60/80 mesh, Tenax GR60/80 mesh (chrome pack); HayeSepD 80/10 mesh (Supelco, Inc.); Chromesorb 10560/80 mesh (Supelco, Inc.); poly dimethyl siloxane (PDMS), and/or Silica Gel 6070/230 mesh (Merck). In exemplary embodiments, substrate 22 can include silicon and/or siloxanes. Substrate 22 can be an adsorbent, in exemplary embodiments, and/or have an affinity, chemically, mechanically, and/or otherwise for at least portions of sample 2. Substrate 22 can be mechanically and/or chemically active. In exemplary embodiments, substrate 22 can be non-inert as apposed to an inert substrate.

Substrate 22 can be coupled to a support 24, for example, via chemical bonding and/or deposition of substrate 22 along support 24, for example. Support 24 can be between substrate 22 and interior walls of chamber 12, for example. Support 24 can be coupled to both substrate 22 and portions of chamber 12, for example, the interior walls of chamber 12.

Substrate 22 can be configured to define a space within the volume of chamber 12. For example, substrate 22 can be configured as a cylinder and the space defined can be the space within the cylinder. In exemplary embodiments, chamber 12 can be configured to contact at least a portion of sample 2 with ionization species with the space defined by substrate 22. According to other embodiments, substrate 22 can be proximate orifice 16 and the chamber can be configured to contact a portion of sample 2 with ionization species proximate orifice 20, in exemplary embodiments.

Assembly 25 can include substrate 22 coupled to support 24. Assembly 25 can be configured to be coupled to an interior portion of chamber 12. Assembly 25 can also define a space within the volume of chamber 12. According to exemplary embodiments, assembly 25 can be configured as a cylinder. Substrate 22 may be coupled to an interior portion of the cylinder, for example. Chamber 12 may also be configured as a cylinder and assembly 25 may be configured to line an interior portion of a cylindrical chamber. Support 24 of assembly 25 may be coupled to an interior portion of chamber 12. For example, support 24 may be removably-coupled and/or removably-operably-coupled to an interior portion of chamber 12.

Assembly 25 may be removed from an ionization source, including chamber 12 configured as an ionization source, according to exemplary embodiments. Assembly 25 may be removed to be replaced and/or reactivated. For example, assembly 25 may be placed in another chamber and/or assembly for reactivation. Such reactivation can include cycled heating and vacuuming of assembly 25 to remove residual analytes that have been retained during previous analyses. Assembly 25 may also be replaced by a reactivated assembly 25 and/or a new assembly 25. Assembly 25 may have many configurations including different substrates that may be selected depending on the analytical needs.

According to an exemplary method of the present disclosure, sample 2 can be provided into chamber 12 through orifice 16 and retained by substrate 22. Sample 2 can be introduced to chamber 12 by allowing sample 2 to flow as a gas to a lower pressure region within chamber 12, for example. Sample 2 can include first and second analytes, and at least a portion the first analyte may be selectively retained within the chamber to the exclusion of at least a portion of the second analyte. In exemplary embodiments, retaining the portion of sample 2 can include the adsorbing of the portion of sample 2 by substrate 22, and the releasing of the portion of sample 2 can include the desorbing of the portion of sample 2 from substrate 22. The adsorbing/desorbing can occur at the same or different portions of substrate 22.

According to one aspect, an electrical potential can be applied to plate 14 and ionization species, such as electrons, generated. The ionization species can be contacted with the portion of first analyte and ionized first analytes can be produced. The ionized first analytes may then be provided to other components, such as detector component 7 (see FIG. 1). Providing the ionized analytes to other components can be accomplished utilizing ion focusing lenses (not shown), for example.

Exemplary mass separator components that can be utilized to receive ionized analytes from chamber 12 can include one or more of linear quadrupoles, triple quadrupoles, quadrupole ion traps (Paul), cylindrical ion traps, linear ion traps, rectilinear ion traps, ion cyclotron resonance, quadrupole ion trap/time-of-flight mass spectrometers, or other structures. Mass separator components can also include focusing lenses as well as tandem mass separator components such as tandem ion traps or ion traps and quadrupoles in tandem. In one implementation, at least one of multiple tandem mass separator components can be an ion trap. Exemplary mass separators include those described in International Patent Application No. PCT/US03/38587, filed Dec. 2, 2003, entitled Processes for Designing Mass Separators and Ion Traps, Methods for Producing Mass Separators and Ion Traps, Mass Spectrometers, Ion Traps, and Methods for Analyzing Samples, the entirety of which is incorporated by reference herein. Tandem mass separator components can be placed in series or parallel. In an exemplary implementation, tandem mass separator components can receive ions from the same ion source component. In an exemplary aspect, the tandem mass separator components may have the same or different geometric parameters. The tandem mass separator components may also receive analyte ions from the same or multiple ion source components.

Analytes may proceed to detector component 7 (FIG. 1). Exemplary detector components include electron multipliers, Faraday cup collectors, photographic and scintillation-type detectors. The progression of analysis from component 4 to detector component 7 can be controlled and monitored by a processing and control device component 8. Exemplary detector components also include those described in U.S. Provisional Patent Application No. 60/607,940 filed Sep. 7, 2004, entitled Mass Spectrometry Analysis Techniques and Mass Spectrometry Circuitry, the entirety of which is incorporated by reference herein.

According to one aspect, when potential is applied to discharge plate 14 creating the actual discharge, the discharge can increase the temperature of substrate 22, thereby facilitating the release of analytes from substrate 22. Laser ionization sources may also be used for generation of ionization species and the subsequent release of analytes. The discharge can also generate ions with a high kinetic energy that impact substrate 22 further expediting the release of analytes. The release of analytes previously retained by substrate 22 within chamber 12 can increase the concentration of the analytes within chamber 12.

Support 24 and/or substrate 22 may be coupled to a heater to further assist the release of analytes from substrate 22. Temperature parameters may be provided to the heater by component 8 to facilitate the selective release of analytes from substrate 22. According to exemplary embodiments, these parameters may be used in combination with other component parameters to develop a database of known data parameters that can be used with comparative software to identify analytes of unknown samples.

In an exemplary aspect, substrate 22 can have varying thicknesses depending on the analysis being performed. For example, where an emphasis of the analysis is sample retention, a thicker substrate 22 may be utilized or, in the cases where the emphasis of the analysis is desorbing or releasing sample from substrate 22, a relatively thinner substrate 22 may be utilized. Support 24 may facilitate the attachment of substrate 22 to the walls of chamber 12 and/or support 24 may be integrated with substrate 22 as part of an assembly 25 described above. In certain aspects of the present invention, assembly 25 may be configured as an attachment to chamber 12. As an attachment, assembly 25 may be incorporated into, removed, and/or replaced in standard ion sources. Assembly 25 may be removed and/or reactivated and/or refurbished and returned to a component 4 as well.

In one aspect of the present disclosure, substrate 22 can be configured to retain and then release analyte from the same side of the substrate 22. In exemplary embodiments, substrate 22 can have first and second sides. Analyte can be retained by the first side and then released from the first side. In other embodiments, analyte can be retained by the first side and released from the second side. The first and second side can oppose one another, for example. Other aspects of the disclosure may utilize substrate 22 having a body and at least two sides. In an exemplary implementation substrate 22 may be configured to retain at least portions of sample 2 on one side and release the portion from another side. Implementations of the present disclosure also provide for the transfer of sample 2 from a retaining side of substrate 22 through its body to a releasing side of substrate 22. Substrate 22 may also be incorporated within an ion source as a liner associated with the walls of the ion source or as an insert to be placed within the chamber of the ion source but apart from the walls of the ion source.

In accordance with aspects of the present invention, substrate 22 may be prepared for further analyses by allowing component 4 to remain activated between analyses and/or through the providing of ion source heaters. In an exemplary aspect, component 4 can be activated after a predetermined amount of time during which sample 2 is retained by substrate 22. Activation can include cooling substrate 22 after repeated cycles of heatings, coolings, and/or vacuuming of substrate 22.

Figure 3:
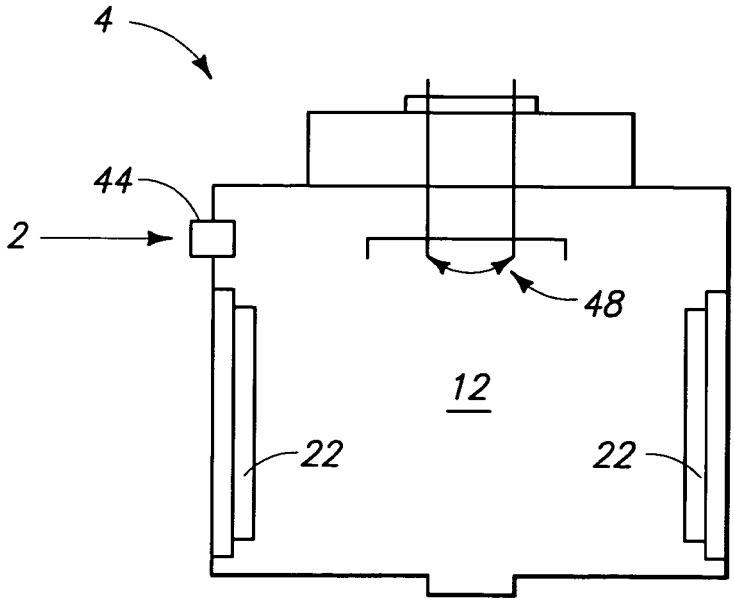
FIG. 3 is a cross-section view of a component of the instrument of FIG. 1 according to an embodiment.

According to another aspect of the present disclosure, component 4 can be configured as shown in FIG. 3. In this configuration, sample 2 enters chamber 12 through a gas line 44. At least a portion of sample 2 can be retained by substrate 22 as described above. Filament 48 can then be used to heat substrate 22 as well as provide ionization species, such as electrons. Filament 48 may extend to within a space defined by substrate 22 and the generation of ionization species can occur within this space. A relatively high pressure may be maintained with chamber 12 when configured as depicted in FIG. 3. To alleviate problems associated with the lifetime of filament 48, gas line 44 can be closed allowing the pumping to reduce pressure in chamber 12. The opening and/or closing of gas line 44 may be facilitated with valves operably-coupled to component 8. According to another aspect of the present invention, component 4 may be configured with filament 48 in a reduced pressure area. One such configuration can include placement of filament 48 in a second chamber (not shown) whereby the second chamber is in fluid connection with chamber 12.

Figure 4:
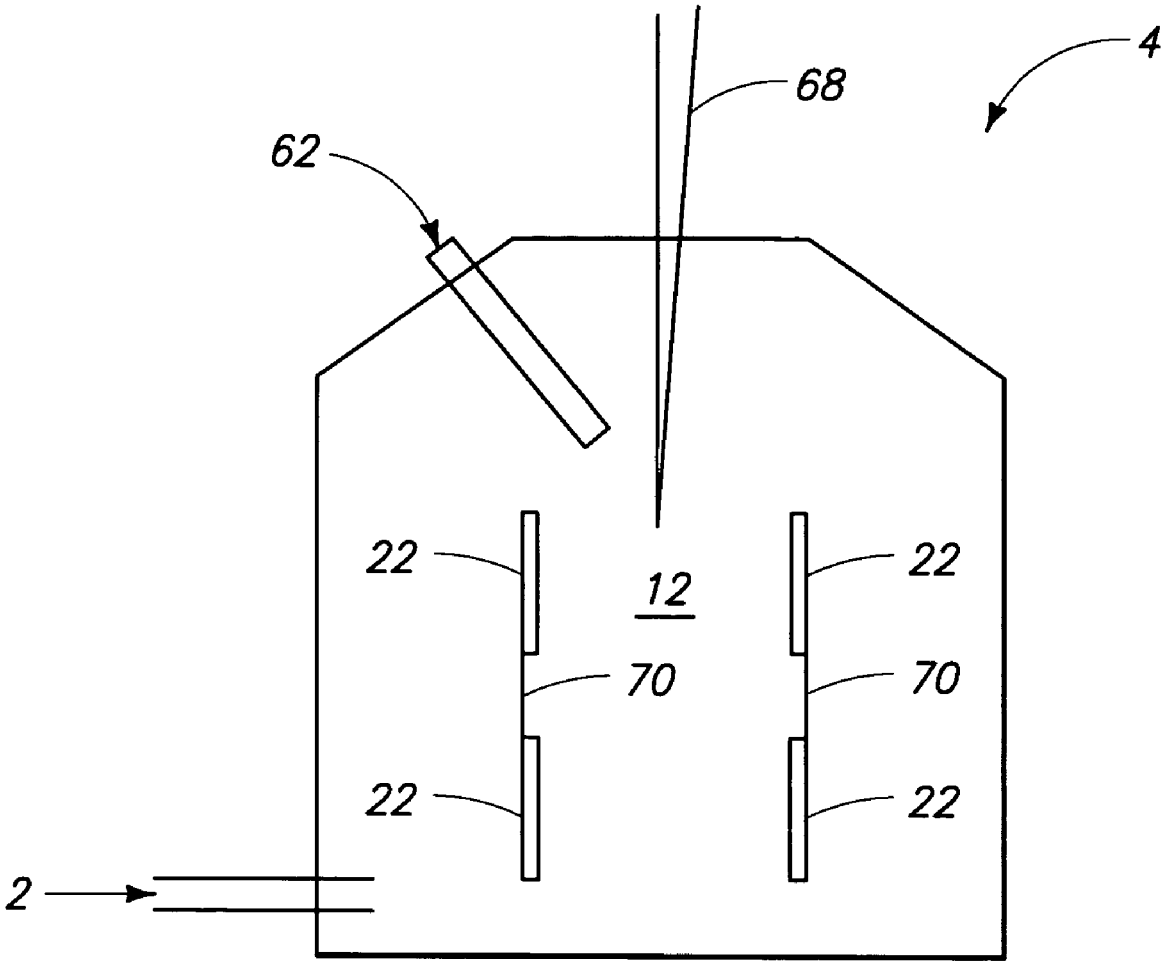
FIG. 4 is a cross-section view of a component of the instrument of FIG. 1 according to an embodiment.

Referring to FIG. 4, component 4 configured for APCI (atmospheric pressure chemical ionization) is depicted according to an embodiment. According to this aspect of the disclosure, sample 2 and a chemical ionization species gas 62 are flowed into chamber 12 where sample 2 is retained by substrate 22. Potential differences can be applied between a corona discharge needle 68 and the discharge electrode 70 which establishes a corona discharge. This discharge can heat substrate 22 as well as generate ions that impact on the surface also heating substrate 22. This discharge can also impact sample 2 and generate ionized analytes. The pressure can be controlled by the flow of sample 2 and gas 62, through the discharge needle 68, and/or by the gas exiting chamber 12 through a small orifice in the middle bottom of the housing (not shown).

As mentioned previously, heating rate can substantially affect the ionization of analytes according to the present invention. These heating rates and the generation of ionization species itself can be controlled by processing and control device component 8 (see, FIG. 1). Acquisition and generation of data can be facilitated with processing and control device component 8. Processing and control device component 8 can be a computer or mini-computer or other appropriate circuitry that is capable of controlling components 4 and 7 as well as additional components, for example. This control can include, for example, the specific application of voltages to component 4 and may further include determining, storing and ultimately displaying data recorded from detector component 7.

Processing and control device component 8 can contain data acquisition and searching software. In one aspect, such data acquisition and searching software can be configured to perform data acquisition and searching that includes the programmed acquisition of total analyte count. In another aspect, data acquisition and searching parameters can include methods for correlating the amount of analytes generated to predetermine programs for acquiring data. Exemplary configurations of processing and control components include those described in U.S. Provisional Patent Application No. 60/607,890 filed Sep. 7, 2004, entitled Analysis Methods and Devices, as well as International Patent Application No. PCT/US04/29029 filed Sep. 4, 2003, entitled Analysis Device Operational Programming Methods and Analysis Device Methods, the entirety of both of which are incorporated by reference herein.

In one aspect such data acquisition and searching software can be configured to comprise acquisition and searching parameters that include the temperature of component 4, rate of increase of temperature, corresponding mass spectra of compounds, and detection corresponding to component 4 temperature. In accordance with known database searching routines, processing and control unit 8 can identify compounds subjected to the analysis described herein. Typically instrument 1 can be calibrated with a known composition such as perfluorotri-n-butylamine (pftba) or perfluorokerosene. Once calibrated, the instrument can provide mass spectra of analytes retained and released by component 4.

Figure 5:
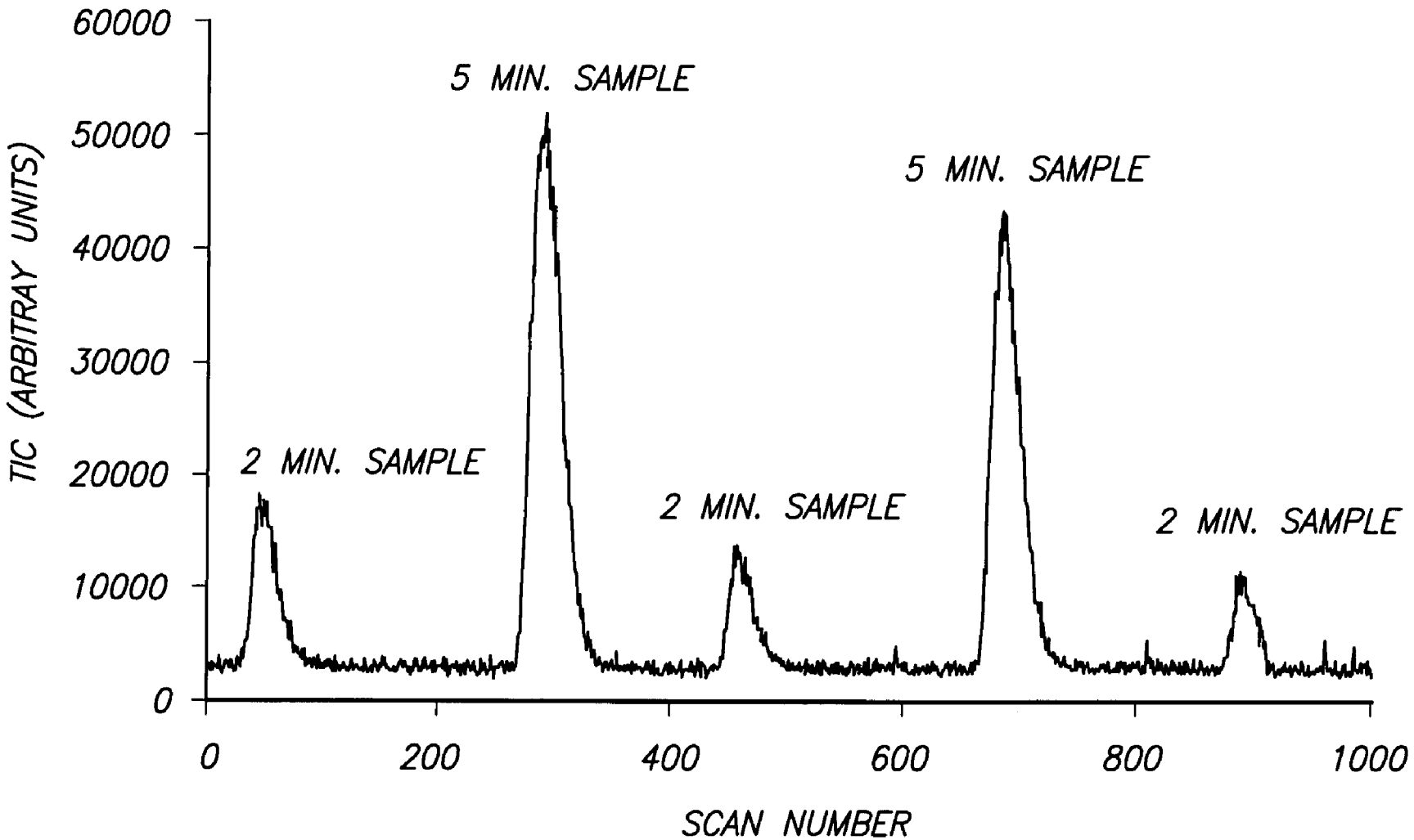
FIG. 5 is a Total Ion Current that can be acquired utilizing the instrument of FIG. 1 according to an embodiment.
Figure 5:
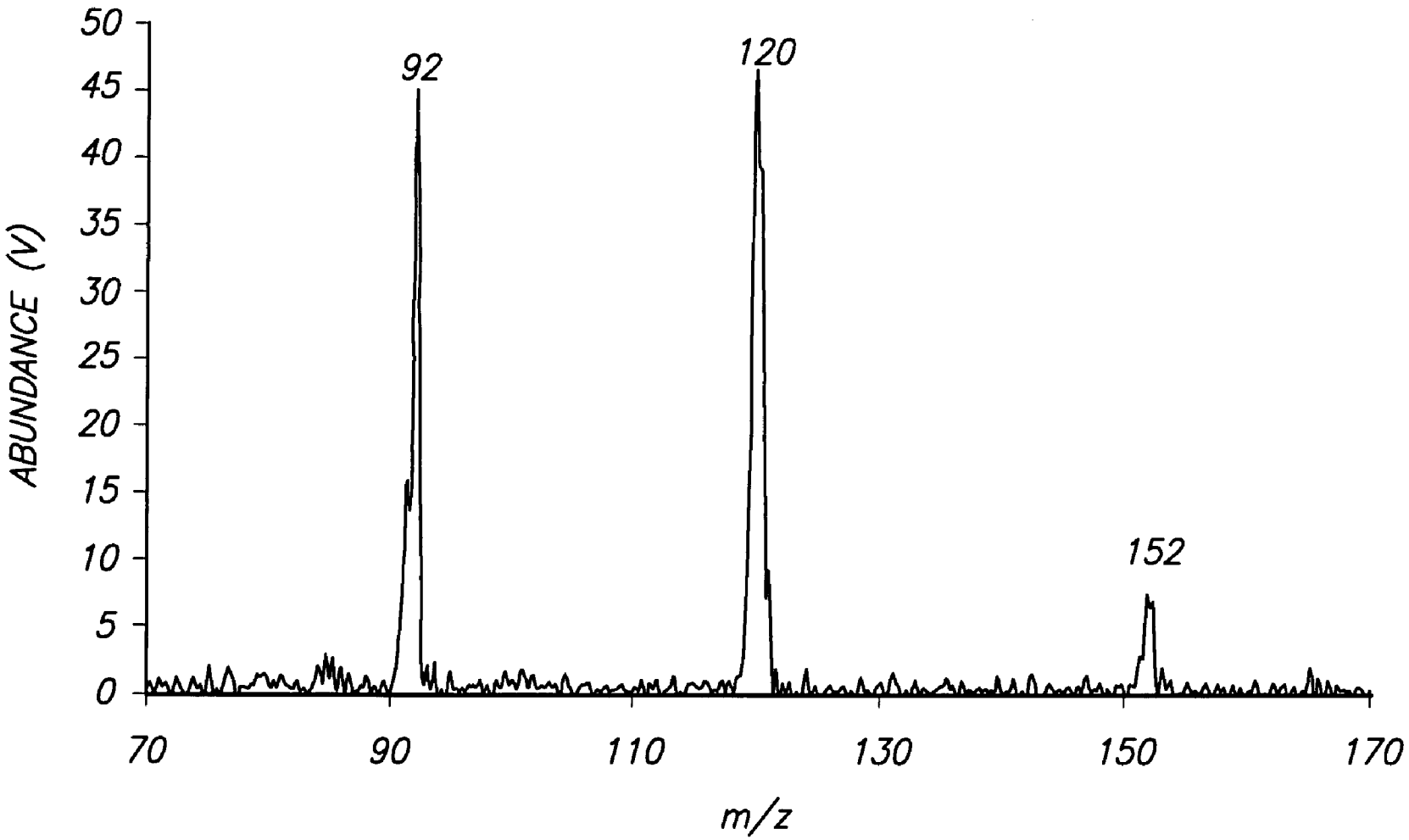

According to an aspect of the present disclosure, component 4 can be incorporated into a mass spectrometer. Component 4 can be configured as illustrated in FIG. 2, with a substrate 22 including PDMS and maintained at a starting temperature of 35° C. and pressure within the volume of chamber 12 of 5 Torr. A sample containing 220 ppb (part per billion by volume) of methyl salicylate can be introduced into component 4 at a flow of 1 mL/min for a period of 1 minute. Component 4 can then be activated to a pressure of 200 Torr and a temperature of 150° C. Ionized analytes can then be forwarded to a mass analyzer and detector components for analysis. Five analyses, (three two-minute sample periods and two five-minute sample periods) can be performed. The resulting Total Ion Current (TIC) and mass spectra are illustrated in FIGS. 5 and 6 respectively.

The invetion claimed is:

1. An instrumental analysis method comprising:

providing an ionization chamber having an active substrate therein;

introducing a gaseous sample to within the chamber;

adsorbing at least a portion of the sample with the active substrate;

after the adsorbing, desorbing the portion of the sample from the active substrate;

after the desorbing, ionizing a component of the portion to form an analyte; and determining the mass/charge ratio of the analyte.

2. The method of claim 1 wherein the ionization chamber is coupled to a mass separator and mass detector, the separator and detector configured to determine the mass/charge ratio of the analyte.

3. The method of claim 1 wherein the active substrate comprises silicon.

4. The method of claim 1 wherein the desorbing comprises heating the active substrate.

5. The method of claim 4 wherein the heating comprises providing ionization species within the ionization chamber.

6. An instrumental analysis method comprising:

providing a gaseous sample to within an ionization chamber having an active substrate and ion source therein;

contacting the gaseous sample with the active substrate to separate one portion of the gaseous sample from another portion of the gaseous sample, the portions having different components;

after the contacting, ionizing the one portion of the sample to form an analyte while retaining the other portion on the active substrate and unionized; and determining the mass/charge ratio of the analyte.

7. The method of claim 6 wherein the active substrate is adjacent the ion source.

8. The method of claim 6 wherein the active substrate is comprised by a liner within the ionization chamber.

9. The method of claim 6 wherein the ion source has a discharge, and the discharge is at least partially framed by the active substrate.

10. The method of claim 9 further comprising heating the substrate with the discharge.

11. An instrumental analysis method comprising:

providing a multi-component gaseous sample to within an ionization chamber;

retaining one portion of the sample on an active substrate within the ionization chamber without retaining another portion of the sample, the sample portions having different components;

removing the other portion of the sample from the ionization chamber;

releasing the one portion of the sample from the active substrate;

after releasing the one portion, ionizing the one portion of the sample to form one analyte; and determining the mass/charge ratio of the one analyte.

12. The method of claim 11 wherein the removing the other portion comprises ionizing the other portion to form another analyte, the analytes having different mass/charge ratios.

13. The method of claim 12 further comprising determining the mass/charge ratios of both the analytes.

14. The method of claim 11 wherein the retaining comprises concentrating the one portion of the sample on the active substrate.

15. The method of claim 11 wherein the one portion comprises a semi-volatile compound and the other portion comprises a volatile compound.

* * * * *